US009388008B2

(12) United States Patent
Horiuchi et al.

(10) Patent No.: US 9,388,008 B2
(45) Date of Patent: Jul. 12, 2016

(54) BASE MATERIAL FOR DISK, PROCESS FOR PRODUCING THE SAME, AND DISK ROLL

(75) Inventors: Osamu Horiuchi, Shizuoka (JP); Kazuhisa Watanabe, Shizuoka (JP); Masaaki Nakayama, Shizuoka (JP)

(73) Assignee: Nichias Corporation, Tokyo (JP)

( * ) Notice: Subject to any disclaimer, the term of this patent is extended or adjusted under 35 U.S.C. 154(b) by 1020 days.

(21) Appl. No.: 12/612,278

(22) Filed: Nov. 4, 2009

(65) Prior Publication Data

US 2010/0113238 A1 May 6, 2010

(30) Foreign Application Priority Data

Nov. 6, 2008 (JP) ..... P 2008-285282

(51) Int. Cl.
*B65H 27/00* (2006.01)

(52) U.S. Cl.
CPC ..... *B65H 27/00* (2013.01); *B65H 2402/80* (2013.01); *B65H 2404/1321* (2013.01); *Y10T 428/21* (2015.01)

(58) Field of Classification Search
CPC ..... Y10T 29/49556; Y10T 29/49549; C04B 2235/5228; B65H 27/00
USPC ..... 492/40; 428/64.1; 264/319; 65/33.7
See application file for complete search history.

(56) References Cited

U.S. PATENT DOCUMENTS

| | | | | |
|---|---|---|---|---|
| 2,917,426 | A * | 12/1959 | Bugosh | 162/145 |
| 3,354,031 | A * | 11/1967 | Kozacik | 162/145 |
| 3,749,638 | A * | 7/1973 | Renaud | 162/145 |
| 3,954,556 | A | 5/1976 | Jackson et al. | |
| 4,244,781 | A | 1/1981 | Heckman | |
| 4,487,631 | A * | 12/1984 | Britt et al. | 106/613 |
| 4,533,581 | A | 8/1985 | Asaumi et al. | |
| 5,322,537 | A * | 6/1994 | Nakamura et al. | 55/523 |
| 5,380,580 | A * | 1/1995 | Rogers et al. | 428/219 |
| 5,579,296 | A | 11/1996 | Smith et al. | |
| 6,896,646 | B2 * | 5/2005 | Kaiser et al. | 492/40 |
| 7,284,328 | B2 * | 10/2007 | Kaiser | 29/895.21 |
| 7,306,773 | B2 * | 12/2007 | Tanaka et al. | 422/179 |
| 7,507,194 | B2 * | 3/2009 | Neubauer et al. | 492/40 |
| 7,781,043 | B2 | 8/2010 | Nakayama et al. | |

(Continued)

FOREIGN PATENT DOCUMENTS

| | | |
|---|---|---|
| CN | 101010262 | 8/2007 |
| EP | 1795505 | 6/2007 |

(Continued)

OTHER PUBLICATIONS

Unifrax Product Information Sheet, http://www.fiberfrax.com/ 2006.*

(Continued)

*Primary Examiner* — Jacob Cigna
(74) *Attorney, Agent, or Firm* — Nixon & Vanderhye P.C.

(57) ABSTRACT

The present invention relates to a process for producing a base material for obtaining therefrom ring-shaped disks for use in a disk roll including a rotating shaft and the ring-shaped disks fitted thereon by insertion, whereby the peripheral surface of the disks serves as a conveying surface, the process including molding a raw slurry material into a platy shape and drying the plate, the raw slurry material containing inorganic fibers which have a wet volume of 300 mL/5 g or larger and which are amorphous or have a degree of crystallinity of 50% or lower.

10 Claims, 1 Drawing Sheet

(56) References Cited

U.S. PATENT DOCUMENTS

| | | | | |
|---|---|---|---|---|
| 2001/0024626 | A1* | 9/2001 | TenEyck | 422/179 |
| 2003/0162019 | A1 | 8/2003 | Zoitos et al. | |
| 2003/0185723 | A1 | 10/2003 | Anji et al. | |
| 2003/0185724 | A1* | 10/2003 | Anji et al. | 422/179 |
| 2004/0007021 | A1 | 1/2004 | Igo et al. | |
| 2004/0220032 | A1* | 11/2004 | Nakayama et al. | 492/40 |
| 2007/0231526 | A1 | 10/2007 | Nakayama et al. | |
| 2008/0120995 | A1* | 5/2008 | Neubauer et al. | 65/33.7 |
| 2010/0064729 | A1 | 3/2010 | Nakayama et al. | |
| 2010/0113238 | A1 | 5/2010 | Horiuchi et al. | |
| 2010/0240511 | A1 | 9/2010 | Nakayama et al. | |
| 2011/0259538 | A1 | 10/2011 | Nakayama et al. | |
| 2011/0287915 | A1 | 11/2011 | Horiuchi et al. | |

FOREIGN PATENT DOCUMENTS

| | | | |
|---|---|---|---|
| JP | 58-156717 | A | 9/1983 |
| JP | 64-61371 | | 3/1989 |
| JP | 01-119616 | | 5/1989 |
| JP | 01-303261 | | 12/1989 |
| JP | 05-099574 | | 4/1993 |
| JP | 09-048628 | | 2/1997 |
| JP | 2000-095536 | | 4/2000 |
| JP | 2003-293754 | | 10/2003 |
| JP | 2004-043240 | A | 2/2004 |
| JP | 2004-269281 | | 9/2004 |
| JP | 2004-299980 | | 10/2004 |
| JP | 2005-515307 | A | 5/2005 |
| JP | 2007-269604 | | 10/2007 |
| JP | 2010-095437 | A | 4/2010 |
| JP | 2010-111541 | A | 5/2010 |
| TW | 255965 | B | 9/1995 |
| TW | I252207 | B | 4/2006 |
| TW | I263611 | B | 10/2006 |
| TW | M304751 | U | 1/2007 |

OTHER PUBLICATIONS

"Vesuvius" product web page, Vesuvius McDaniel, <http://glasswebsite.com/divisions/tempering/profiles/Vesuvius.asp>, Ret. Oct. 2014 Archive.org, dated May 14, 2004.* http://www.wolframalpha.com calculations performed Jun. 12, 2015.*

JP Office Action with partial English translation in JP 2008-285282 dated Jul. 3, 2012.

Search and Examination Report in Singapore Appln. SN 200907294-3 mailed Oct. 1, 2012.

U.S. Appl. No. 13/111,116, filed May 19, 2011 in the name of Watanabe et al.

U.S. Appl. No. 13/067,836, filed Jun. 29, 2011 in the name of Nakayama et al.

U.S. Appl. No. 12/801,166, filed May 26, 2010 in the name of Nakayama et al.

Fiberfrax Unifrax product sheet; http://www.fiberfrax.com/files/Fiberfrax-Bulk-Fiber.pdf (copyright 2007) ret. Jan. 8, 2014.

Office Action issued in Taiwanese Application No. 098137704 dated Mar. 23, 2015.

* cited by examiner

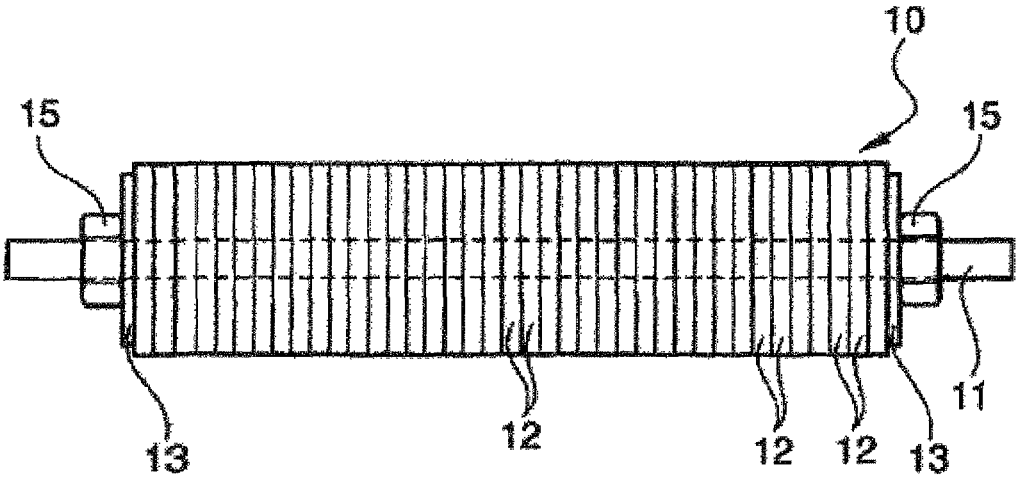
10
15
15
11
13
12
12
12
13

BASE MATERIAL FOR DISK, PROCESS FOR PRODUCING THE SAME, AND DISK ROLL

FIELD OF THE INVENTION

The present invention relates to a disk roll which comprises a rotating shaft and ring-shaped disks fitted thereon by insertion, whereby the peripheral surface of the disks serve as a conveying surface. The invention further relates to a base material for those disks and relates to a process for producing the base material.

BACKGROUND OF THE INVENTION

Disk rolls are used, for example, for conveying a glass plate descending from a melting furnace or for conveying a metal plate, e.g., a stainless-steel plate, heated in an annealing furnace. As shown in FIG. 1, a disk roll 10 is built in the following manner. Ring-shaped disks 12 containing inorganic fibers and an inorganic filler are fitted by insertion onto a metallic shaft 11 serving as a rotating shaft. Thus, a roll-form stack is obtained. The whole stack is pressed through flanges 13 disposed respectively on both ends, and these disks 12 in this slightly compressed state are fastened with nuts 15. In the disk roll 10 thus obtained, the peripheral surface of the disks 12 functions as a conveying surface (see, for example, JP-A-2004-299980 and JP-A-2004-269281).

SUMMARY OF THE INVENTION

However, such disk rolls have the following problems. The glass plates or stainless-steel plates to be conveyed have increased in area in these days and, hence, the conveyance time per plate has become longer. The time period of contact with the disks also has become longer. Because of this, the disks heat up to a higher temperature than before and have come to have a larger difference than before in temperature between before and after the conveyance, i.e., between the time when the disks are in contact with a glass plate or stainless-steel plate and the time when the contact has terminated. In periodic inspections also, there are cases where the disks are rapidly cooled.

In such cases, the disks thermally shrink before the metallic shaft, which has a high heat capacity, thermally shrinks. There is hence a fear that disk separation (the phenomenon in which a gap is formed between disks) may occur and the roll surface (conveying surface) may crack due to a thermal stress attributable to a temperature difference (difference in thermal expansion) between the outside (surface) and the inside (inner parts) of the disks.

The invention has been achieved in view of those problems. An object of the invention is to provide a disk roll which, even when rapidly cooled, suffers neither disk separation nor cracking and which has excellent spalling resistance.

Namely, the present invention relates to the following items (1) to (6).

(1) A process for producing a base material for obtaining therefrom ring-shaped disks for use in a disk roll comprising a rotating shaft and the ring-shaped disks fitted thereon by insertion, whereby the peripheral surface of the disks serves as a conveying surface, the process comprising molding a raw slurry material into a platy shape and drying the plate, the raw slurry material containing inorganic fibers which have a wet volume of 300 mL/5 g or larger and which are amorphous or have a degree of crystallinity of 50% or lower.

(2) The process for producing a base material for disks according to (1), wherein the inorganic fibers have an average fiber diameter of 3-7 μm.

(3) The process for producing a base material for disks according to (1) or (2), wherein the inorganic fibers have a composition in which $Al_2O_3$:$SiO_2$ is from 60:40 to 99:1.

(4) A disk for use in a disk roll comprising a rotating shaft and ring-shaped disks fitted thereon by insertion, whereby the peripheral surface of the ring-shaped disks serves as a conveying surface, the disk being each of the ring-shaped disks, the disk containing inorganic fibers which are amorphous or have a degree of crystallinity of 50% or lower and which have an average fiber diameter of 3-7 μm, and having a recovery ratio of 10-100%.

(5) A disk roll which comprises a rotating shaft and disks fitted thereon by insertion, the disks each being the disk according to (4).

(6) The disk roll according to (5), wherein the disks have a compressed density of 0.6-1.6 g/cm$^3$.

According to the invention, relatively long inorganic fibers can be caused to remain in disks even after roll building and, hence, the flexibility of the inorganic fibers can be maintained/exhibited. As a result, the disks can retain a high recovery ratio and can mitigate/absorb the stress attributable to a difference in thermal expansion. Consequently, a disk roll which, even when rapidly cooled, suffers neither disk separation nor cracking and which has excellent spalling resistance, can be provided.

BRIEF DESCRIPTION OF THE DRAWINGS

FIG. 1 is a diagrammatic view illustrating one embodiment of the disk roll.

DESCRIPTION OF THE REFERENCE NUMERALS

10 Disk roll
11 Metallic shaft
12 Disk
13 Flange
15 Nut

DETAILED DESCRIPTION OF THE INVENTION

The invention is explained below in detail by reference to the drawing.

Base Material for Disk

The invention provides a base material for disks which is for producing therefrom the disks 12 constituting a disk roll 10 such as that shown in FIG. 1. The base material for disks of the invention is obtained by molding a slurry containing inorganic fibers which have a wet volume of 300 mL/5 g or larger and which are amorphous or have a degree of crystallinity of 50% or lower into a platy shape and drying the plate. The inorganic fibers are a mixture of fibers having various lengths. In the invention, the fiber lengths of the inorganic fibers are expressed in terms of wet volume.

The above-mentioned wet volume is calculated by the following method having the following steps:

(1) 5 grams of a dried fiber material is weighed by weigher with accuracy of two or more decimal places;

(2) The weighed fiber material is placed in a 500 g glass beaker;

(3) About 400 cc of distilled water having a temperature of 20 to 25° C. is poured into the glass beaker prepared in the step (2), and stirring is carefully performed by using a stirrer so as not to cut the fiber material, thereby dispersing the fiber material. For this dispersion, an ultrasonic cleaner may be used;

(4) The content of the glass beaker prepared in the step (3) is transferred into a 1,000 ml graduated measuring cylinder, and distilled water is added thereto up to the scale of 1,000 cc;

(5) Stirring of the graduated measuring cylinder prepared in the step (4) is performed by turning the cylinder upside down while blocking an opening of the graduated measuring cylinder with the palm of a hand carefully to prevent water from leaking out. This procedure is repeated 10 times in total;

(6) the sedimentation volume of fiber is measured by visual observation after placing the graduated measuring cylinder quietly under room temperature for 30 minutes after the stop of the stirring; and (7) The above-mentioned operation is performed for 3 samples, and an average value thereof is taken as a measured value.

The larger the wet volume, the larger the fiber lengths. In the invention, inorganic fibers having a wet volume of 300 mL/5 g or larger, preferably 400 mL/5 g or larger, more preferably 500 mL/5 g or larger is used. There is no particular upper limit on the wet volume thereof so long as the effects of the invention are obtained. For example, the wet volume of the inorganic fibers may be 2,000 mL/5 g or smaller, preferably 1,500 mL/5 g or smaller, more preferably 1,200 mL/5 g or smaller. Inorganic fibers are mixed with stirring with an inorganic filler and other ingredients in water in order to slurry the inorganic fibers, and are hence cut during the stirring, whereby the disks obtained therefrom contain inorganic fibers having a short fiber length. Because of this, such disks have low resiliency and are incapable of adapting to abrupt temperature changes, resulting in disk separation or cracking. In contrast, the inorganic fibers to be used in the invention, which have the wet volume shown above, are bulk short fibers. Even when stirred and mixed in slurry formation, the inorganic fibers to be used in the invention remain longer than the inorganic fibers used hitherto. The disks obtained therefrom also contain relatively long inorganic fibers and, hence, the flexibility of the inorganic fibers can be maintained/exhibited. As a result, the stress attributable to a difference in thermal expansion can be mitigated/absorbed, and the spalling resistance of a disk roll can be improved.

In the invention, the inorganic fibers are an amorphous material, i.e., have a degree of crystallinity of 0%, or have a degree of crystallinity of 50% or lower. The lower the degree of crystallinity of inorganic fibers, the higher the strength of the fibers. Consequently, the inorganic fibers are less apt to break even when the fibers are stirred in the slurry or receive compressive force in a roll building step. The disks can hence retain recovery force. As a result, disks having high strength and a high recovery ratio are obtained. From the standpoint of obtaining such effects without fail, the upper limit of the degree of crystallinity of the inorganic fibers is preferably 30% or lower, more preferably 20% or lower, even more preferably 10% or lower. Most preferably, the inorganic fibers are amorphous inorganic fibers. In the invention, the degree of crystallinity may be determined by X-ray diffractometry, in which the internal standard method is used to draw a calibration curve for mullite to determine the degree of crystallinity.

The average fiber diameter of the inorganic fibers is not particularly limited so long as the effects of invention are obtained. However, it is preferred that the inorganic fibers should be relatively thick inorganic fibers having an average fiber diameter of 3-7 μm, preferably 4-7 μm. Such thick inorganic fibers have excellent fiber strength and are hence less apt to break even when the inorganic fibers are stirred in the slurry or receive compressive force in a roll building step. Therefore, the inorganic fibers enable the disks to retain recovery force. As a result, a base material having high strength and a high recovery ratio can be provided.

The composition of the inorganic fibers is not particularly limited so long as the effects of the invention are obtained. However, $Al_2O_3$:$SiO_2$ is preferably from 60:40 to 99:1. Inorganic fibers having such a composition are called alumina fibers or mullite fibers. These inorganic fibers have high heat resistance and, hence, can give disks having a low degree of thermal dimensional change. In particular, mullite fibers in which $Al_2O_3$:$SiO_2$ is from 70:30 to 75:25 have an excellent balance among heat resistance, fiber strength, and cost and are hence apt to retain a large fiber length even after a molding step and a roll building step. Consequently, these mullite fibers are suitable for use in the invention.

The slurry may contain an inorganic filler in addition to the inorganic fibers, as in conventional slurries. According to need, the slurry may contain an inorganic binder. Suitable examples of the inorganic filler include inorganic fillers heretofore in use, such as mica, Kibushi clay, bentonite, alumina, cordierite, kaolin clay, and talc. Suitable inorganic binders are silica sol and alumina sol because of their excellent heat resistance. Besides these ingredients, molding aids may be added, such as an organic binder, e.g., starch, organic fibers, e.g., a pulp, and an anticoagulant, e.g., a montmorillonite powder. The remainder is water.

The composition of the slurry is not limited. In the case where the inorganic filler and the inorganic binder are added to the slurry, the solid composition of the slurry may be one comprising 30-70% by mass of the inorganic fibers, 30-70% by mass of the inorganic filler, and 0-10% by mass of the inorganic binder. The solid composition thereof more preferably comprises 30-60% by mass of the inorganic fibers, 40-70% by mass of the inorganic filler, and 0-10% by mass of the inorganic binder, and even more preferably comprises 30-50% by mass of the inorganic fibers, 50-70% by mass of the inorganic filler, and 0-10% by mass of the inorganic binder. In case where the proportion of the inorganic fibers is smaller than 30% by mass, the resiliency attributable to the inorganic fibers is not obtained and there is a fear that the expected recovery ratio which will be described later cannot be obtained after roll building. In case where the proportion of the inorganic fibers is larger than 70% by mass, it is difficult to evenly disperse the inorganic fibers in the slurry and there is a fear that the disk base material obtained may have enhanced unevenness of properties or poor wearing resistance.

With regard to the molding method, a papermaking method or a dehydrating molding method in which the slurry is supplied to one side of a molding die, e.g., a metal gauze, while conducting suction from the other side, may be mentioned. However, in the case where such a slurry containing the relatively long bulk short fibers described above is molded into a platy shape, large flocs are apt to generate as a result of the coagulation of solid matters contained in the slurry and the filtration resistance is apt to be lowered. The dehydrating molding method is hence advantageous. However, in the case where the amount of the inorganic fibers is small (e.g., 20% by mass or smaller), a papermaking method is also possible. The papermaking method is advantageous from the standpoint of cost.

After the molding, the resultant platy object is dried to obtain a base material for disks. The density of this base material for disks is not particularly limited so long as the effects of the invention are obtained. However, the density thereof may be 0.3-1.0 g/cm$^3$, and is more preferably 0.4-0.8 g/cm$^3$, especially preferably 0.45-0.7 g/cm$^3$. This is because the lower the bulk density of the disks relative to the compressed density of the disk roll to be produced, the higher the compressibility and the better the recovery force of the disk roll. The adequate thickness of the base material for disks may be 2-10 mm in the case of the papermaking method, and may be 10-35 mm in the case of the dehydrating molding method. Larger thicknesses of the base material for disks are advantageous from the standpoint of production because a smaller number of disks suffice for fitting on a shaft.

Disk

The invention further provides a disk obtained by punching a ring shape out of the base material for disks described above. Namely, the disk of the invention comprises inorganic fibers which are amorphous or have a degree of crystallinity of 50% or lower and which have an average fiber diameter of preferably 3-7 μm, more preferably 4-7 μm, and an inorganic filler. The disk may contain an inorganic binder according to need. This constitution enables the disk to retain a high recovery ratio and have improved spalling resistance. Specifically, the recovery ratio of the disk is 10-100%, preferably 10-90%, more preferably 10-80%, even more preferably 20-70%, especially 20-60%, most preferably 20-50%. In the invention, the recovery ratio of disks is determined in the following manner. Disks having an outer diameter of 130 mm and an inner diameter of 65 mm are fitted onto a stainless-steel shaft having a diameter of 65 mm and a length of 1,000 mm at a compressed density of 1.25 g/cm$^3$ to build a disk roll. This disk roll is rotated at a rotation speed of 5 rpm for 150 hours with heating at 900° C., and then cooled to room temperature, i.e., 25° C. Thereafter, the compressive force applied to the disks is removed. The recovery ratio is determined by dividing the length recovered upon the compressive-force removal by the original length.

Disk Roll

The invention furthermore provides a disk roll obtained by fitting disks of the kind described above, by insertion, onto a metallic shaft serving as a rotating shaft to obtain a roll-form stack and fixing the whole stack in the state of being compressed from both ends, as shown in FIG. 1. The compressed density of the disks, i.e., the density of the disks in the state of being compressed from both sides, is not particularly limited so long as the effects of the invention are obtained. However, the compressed density thereof may be 0.6-1.6 g/cm$^3$, and is more preferably 0.7-1.5 g/cm$^3$, especially preferably 1.1-1.4 g/cm$^3$. Such compressed density is preferred because this disk roll not only has satisfactory spoiling resistance and can retain the wearing resistance required of conveying rolls but also has such a surface hardness that the work being conveyed is not marred. That compressed density enables the properties the base material obtained according to the invention to be brought out to the highest degree.

The surface hardness of the disk roll of the invention is not particularly limited so long as the effects of the invention are obtained. However, the surface hardness thereof may be 25-65 in terms of Type D Durometer hardness, and may be preferably 30-60, more preferably 35-55. Type D Durometer hardness (hardness meter Durometer Type D) may be measured, for example, with "ASKER Type D Rubber Hardness Meter" (manufactured by Kobunshi Keiki Co., Ltd.).

EXAMPLES

The invention will be further explained below by reference to Test Examples. However, the invention should not be construed as being limited by the following Test Examples in any way.

Test 1

Aluminosilicate fibers or mullite fibers were added to water together with inorganic fillers and molding aids as shown in Table 1, and the ingredients were sufficiently stirred and mixed to prepare a slurry. The wet volumes of the aluminosilicate fibers and mullite fibers were determined by the method described above. The degree of crystallinity thereof was determined by X-ray diffractometry, in which the internal standard method was used to draw a calibration curve for mullite.

Each of the slurries thus prepared was formed into a platy shape by the dehydrating molding method or the papermaking method and dried to produce a base material for disks. The base material was evaluated for the following properties. The results obtained were also shown in Table 1.

(1) Degree of Thermal Dimensional Change

A test piece was punched out of each base material for disks. The test piece was heated at 700° C. or 900° C. and then examined for diameter. The degree of thermal change in the length-direction (diameter-direction) dimension from a value measured before the heating was determined.

(2) Recovery Ratio

Disks having an outer diameter of 130 mm and an inner diameter of 65 mm were punched out of each base material for disks, and fitted onto a stainless-steel shaft having a diameter of 65 mm and a length of 1,000 mm to build a roll so as to result in a compressed density of 1.25 g/cm$^3$. This roll was rotated at 900° C. and a rotation speed of 5 rpm for 150 hours and then cooled to room temperature, i.e., 25° C. Thereafter, the compressive force applied to the disks was removed. The recovery ratio (%) was determined by dividing the length recovered upon the compressive-force removal by the original length.

(3) Wearing Resistance (Hot Wearing Test)

Ring-shaped disks having an outer diameter of 80 mm were punched out of each base material for disks and fitted onto a stainless-steel shaft to build a roll so as to result in a width of 100 mm and a desired compressed density. This roll was rotated at 900° C. for 5 hours while a stainless-steel shaft having a diameter of 30 mm and having five grooves with a width of 2 mm formed at an interval of 2 mm was kept in contact with the roll surface. Thereafter, the roll was cooled to room temperature, i.e., 25° C., and the resultant wear loss (mm) was measured. Incidentally, in case where the resultant wear loss is 8 mm or less, this roll can be rated as excellent in practical wear resistance.

(4) Spalling Resistance

Ring-shaped disks having an outer diameter of 60 mm were punched out of each base material for disks and fitted onto a stainless-steel shaft to build a roll so as to result in a width of 100 mm and a desired compressed density. This roll was placed in an electric furnace kept at 900° C. After 15 hours, the roll was taken out of the furnace and rapidly cooled to room temperature, i.e., 25° C. This heating/rapid-cooling operation was repeated, and the number of such operations required for the roll to undergo disk separation or cracking was counted. In the case where a roll undergoes neither disk separation nor cracking even through three or more repetitions of such heating/rapid-cooling operation, this roll can be rated as excellent in practical spalling resistance.

TABLE 1

| | | Composition | Wet volume (mL/5 g) | Average Fiber diameter (μm) | Degree of crystal-linity (%) | Example 1 | Example 2 | Example 3 | Example 4 | Comp. Ex. 1 | Comp. Ex. 2 |
|---|---|---|---|---|---|---|---|---|---|---|---|
| Formulation (parts by mass) | Inorganic fibers | Alumino-silicate | 850 | 2.5 | 0 | | | | 40 | | |
| | | | 20 | 2.5 | 0 | | | | | 40 | |
| | | Mullite | 970 | 3.0 | 0 | | | 40 | | | |
| | | | 990 | 5.0 | 0 | 40 | | | | | |
| | | | 530 | 5.0 | 0 | | 40 | | | | |
| | | | 200 | 5.0 | 80 | | | | | | 40 |
| | Inorganic filler | Mica | | | | 30 | 30 | 30 | 30 | 30 | 30 |
| | | Kibushi clay | | | | 10 | 10 | 10 | 10 | 10 | 10 |
| | | Bentonite | | | | 10 | 10 | 10 | 10 | 10 | 10 |
| | Molding aid | Pulp | | | | 5 | 5 | 5 | 5 | 5 | 5 |
| | | Organic binder | | | | 5 | 5 | 5 | 5 | 5 | 5 |
| Property | Disk | Density (g/cm$^3$) | | | | 0.62 | 0.6 | 0.56 | 0.61 | 0.54 | 0.6 |
| | | Degree of thermal dimensional change (%) | | 700° C. | | 0.0 | 0.0 | 0.0 | 0.0 | −0.1 | 0.0 |
| | | | | 900° C. | | 0.1 | 0.0 | 0.1 | 0.2 | 0.1 | 0.1 |
| | | Molding method | | | | dehy-drating molding with suction | dehy-drating molding with suction | dehy-drating molding with suction | dehy-drating molding with suction | paper-making | dehy-drating molding with suction |
| | Disk roll | Compressed density (g/cm$^3$) | | | | 1.25 | 1.25 | 1.25 | 1.25 | 1.25 | 1.25 |
| | | Recovery ratio (%) | | | | 30 | 24 | 12 | 10 | 2 | 7 |
| | | Surface hardness (Shore D) | | | | 38 | 35 | 32 | 59 | 46 | 42 |
| | | Wearing resistance (hot wearing test) | | | | 0.3 | 0.3 | 1.4 | 0.2 | 0.2 | 9.4 |
| | | Evaluation of spalling resistance | | | | 8 times | 14 times | 6 times | 4 times | 2 times | 2 times |

The following can be seen from Table 1. In Examples 1 to 4, in which mullite fibers having a wet volume of 300 mL/5 g or larger and a degree of crystallinity of 50% or lower are used, disks having a low degree of thermal dimensional change and excellent in wearing resistance and spalling resistance are obtained.

Test 2

As shown in Table 2, slurries were prepared using, in various amounts, amorphous mullite fibers having a wet volume of 530 mL/5 g. The disks obtained therefrom were evaluated for the same properties as in Test 1. The results obtained are also shown in Table 2.

It can be seen from Table 2 that when the amount of the mullite fibers incorporated is 30-60% by mass, preferably 30-50% by mass, the disks are excellent in recovery ratio, wearing resistance, and spalling resistance.

Test 3

Disks were produced using the same formulation as in Example 2 in Test 1. Disk rolls having different compressed densities as shown in Table 3 were produced and evaluated for the same properties as in Test 1. The results obtained are also shown in Table 3.

TABLE 2

| | | Composition | Wet volume (mL/5 g) | Average fiber diameter (μm) | Degree of crystal-linity (%) | Example 5 | Example 6 | Example 2 | Example 7 | Example 8 | Example 9 |
|---|---|---|---|---|---|---|---|---|---|---|---|
| Formulation (parts by mass) | Inorganic fibers | Mullite | 530 | 5.0 | 0 | 20 | 30 | 40 | 50 | 60 | 70 |
| | Inorganic filler | Mica | | | | 30 | 30 | 30 | 20 | 10 | 0 |
| | | Kibushi clay | | | | 30 | 20 | 10 | 10 | 10 | 10 |
| | | Bentonite | | | | 10 | 10 | 10 | 10 | 10 | 10 |
| | Molding aid | Pulp | | | | 5 | 5 | 5 | 5 | 5 | 5 |
| | | Organic binder | | | | 5 | 5 | 5 | 5 | 5 | 5 |
| Property | Disk | Density (g/cm$^3$) | | | | 0.72 | 0.64 | 0.6 | 0.52 | 0.44 | 0.32 |
| | | Degree of thermal dimensional change (%) | | 700° C. | | −0.1 | 0.0 | 0.0 | 0.0 | 0.0 | 0.0 |
| | | | | 900° C. | | −0.2 | 0.0 | 0.0 | 0.0 | 0.1 | 0.2 |
| | | Molding method | | | | paper-making | dehy-drating molding with suction | dehy-drating molding with suction | dehy-drating molding with suction | dehy-drating molding with suction | dehy-drating molding with suction |
| | Disk roll | Compressed density (g/cm$^3$) | | | | 1.25 | 1.25 | 1.25 | 1.25 | 1.25 | 1.25 |
| | | Recovery ratio (%) | | | | 12 | 17 | 24 | 30 | 33 | 36 |
| | | Surface hardness (Shore D) | | | | 37 | 34 | 35 | 35 | 31 | 33 |
| | | Wearing resistance (hot wearing test) | | | | 0.3 | 0.2 | 0.3 | 5 | 8 | 12 |
| | | Evaluation of spalling resistance | | | | 2 times | 5 times | 14 times | 12 times | 13 times | 14 times |

TABLE 3

| | | | Example 10 | Example 11 | Example 12 | Example 2 | Example 13 | Example 14 | Example 15 |
|---|---|---|---|---|---|---|---|---|---|
| Property | Disk roll | Compressed density (g/cm$^3$) | 0.7 | 0.8 | 1.1 | 1.25 | 1.4 | 1.5 | 1.6 |
| | | Surface hardness (Shore D) | 15 | 23 | 30 | 35 | 54 | 64 | 78 |
| | | Wearing resistance (hot wearing test) | 11 | 5 | 0.8 | 0.3 | 0.3 | 0.2 | 0.4 |
| | | Evaluation of spalling resistance | 11 times | 9 times | 11 times | 14 times | 10 times | 5 times | 2 times |

It can be seen from Table 3 that the compressed densities of the disks are preferably 0.7-1.5 g/cm$^3$, more preferably 1.1-1.4 g/cm$^3$.

The invention was detailed with reference specified embodiments. However, it is obvious to a person skilled in the art that the invention may be variously modified and corrected without deviating from the spirit of the invention.

This application is based on Japanese Patent Application No. 2008-285282 filed on Nov. 6, 2008 and an entirety thereof is incorporated herein by reference.

Furthermore, all references cited here are incorporated by reference.

What is claimed is:

1. A disk roll comprising: a rotating shaft; and a plurality of ring-shaped disks that are fitted on the rotating shaft by insertion; the disks comprising, inorganic fibers which are amorphous or have a degree of crystallinity of 50% or lower and have an average fiber diameter of 4 to 7 μm, and at least one inorganic filler selected from mica, Kibushi clay, bentonite, alumina, cordierite, kaolin clay, talc, and combinations thereof, the disks having a recovery ratio of 10 to 100%, and the total of the inorganic fibers and the at least one inorganic filler being 90% by mass or more.

2. The disk roll according to claim 1, wherein the disks have a compressed density of 0.7 to 1.6 g/cm$^3$.

3. The disk roll according to claim 1, wherein the inorganic fibers have a composition in which $Al_2O_3$:$SiO_2$ is from 60:40 to 99: 1.

4. The disk roll according to claim 1, wherein the disks comprise 30-70% by mass of the inorganic fibers, 30-70% by mass of the inorganic filler, and 0-10% by mass of an inorganic binder.

5. The disk roll according to claim 1, wherein the disks comprise 30-60% by mass of the inorganic fibers, 40-70% by mass of the inorganic filler, and 0-10% by mass of an inorganic binder.

6. The disk roll according to claim 1, wherein the disks comprise 30-50% by mass of the inorganic fibers, 50-70% by mass of the inorganic filler, and 0-10% by mass of an inorganic binder.

7. The disk roll according to claim 1, which when the disk roll is heated and kept at 900° C. for 15 hours and thereafter rapidly cooled to room temperature 25° C., and then the heating and cooling are repeated two times; the disk roll suffers neither disk separation nor cracking.

8. A process for producing a disk roll comprising:

preparing a plurality of ring-shaped disks, and fitting the plurality of ring-shaped disks on a rotatable shaft by insertion;

the disks comprising, inorganic fibers which are amorphous or have a degree of crystallinity of 50% or lower and have an average fiber diameter of 4 to 7 μm, and at least one inorganic filler selected from mica, Kibushi clay, bentonite, alumina, cordierite, kaolin clay, talc, and combinations thereof, the disks having a recovery ratio of 10 to 100%, and the total of the inorganic fibers and the at least one inorganic filler being 90% by mass or more.

9. A method for conveying molten glass plate or heated metal plate comprising contacting the molten glass plate or heated metal plate over a conveying rotating surface of the disk roll according to claim 1.

10. A method for conveying molten glass plate or heated metal plate comprising contacting the molten glass plate or heated metal plate over a conveying rotating surface of the disk roll according to claim 7.

* * * * *